United States Patent [19]

Petillo

[11] 4,064,779

[45] Dec. 27, 1977

[54] FRET

[76] Inventor: Phillip J. Petillo, 1206 Herbert Ave., Ocean, N.J. 07712

[21] Appl. No.: 698,318

[22] Filed: June 22, 1976

[51] Int. Cl.[2] ..... G10D 3/06

[52] U.S. Cl. ..... 84/314

[58] Field of Search ..... 84/314, 293, 297 R

[56] References Cited

U.S. PATENT DOCUMENTS

| | | | |
|---|---|---|---|
| 463,954 | 11/1891 | Middlebrooke | 84/314 |
| 501,743 | 7/1893 | Stratton | 84/314 |
| 1,472,943 | 11/1923 | Shaeffer | 84/314 |
| 2,489,408 | 11/1949 | Frost | 84/314 |
| 3,273,439 | 9/1966 | Keefe et al. | 84/314 |
| 3,787,600 | 1/1974 | Muncy | 84/314 |

*Primary Examiner*—Stephen J. Tomsky

*Attorney, Agent, or Firm*—Roger A. Clapp

[57] ABSTRACT

A substantially T-shaped fret for a stringed instrument is disclosed which has an elongated stem topped by a triangularly shaped cap.

5 Claims, 5 Drawing Figures

FRET

BACKGROUND OF THE INVENTION

1. Field of the Invention

This invention pertains to components for use with stringed instruments and relates in particular to frets which are inserted in the instrument neck.

2. Description of the Prior Art

Stringed instruments typically include a neck over which the strings extend. The strings are plucked to provide tones and tone changes are achieved by varying string length. Frets are inserted in the neck at pre-determined locations beneath the strings and string length is adjusted by pressing the string into contact with a specific fret.

Conventionally, the frets are made of a metal such as nickel silver and have a somewhat T-shaped configuration wherein the stem of the T is inserted in the instrument neck and the cap provides a bearing surface for the strings. The spacing of the frets is such that the central axis passing longitudinally through the long axis of the stem is located at a point which, in reference to the fixed end of the strings, defines a distance such that a string of length equivalent to that distance will provide a tone of precise frequency when the string is plucked.

Heretofore, the cap of the fret has had a convex shape. That is, it bulges upwardly away from the stem. Thus, when the frets are in place on the neck, they present a series of parallel ridges all having a rounded surface projecting upwardly towards the strings.

While the spacing of the frets with respect to each other can readily be maintained with precision, the height of the caps above the neck surface often varies. Such height variations must be eliminated, however, so that all of the strings will be properly spaced above the fret surface. The spacing between the strings and the frets must be properly established so as to produce proper tonal qualities. Consequently, it is custumary to grind the raised surfaces of the fret caps until all are coincident with a common plane lying parallel to the neck surface.

While grinding in the described manner readily produces the desired constancy of fret height, tone variations are nevertheless often experienced when the instrument is played.

Accordingly, one object of this invention is to achieve proper spacing between the fret tops and the strings without impairing tonal accuracy when the instrument is played.

In analyzing conventional frets, it has been discovered that the flats caused by grinding become so large that the point of contact between string and fret shifts away from the central axis of the fret when contact is made. As a result, the actual string length fails to coincide with the designed string length and an inaccuracy of tone results when the string is plucked. It is important, therefore, that the actual string length approach coincidence with the designed string length in order to produce instruments of quality. The movements towards coincidence, however, must not adversely affect the instrument's playing characteristics.

Accordingly, another object of this invention is to achieve a closer approach to coincidence between designed string length and the actual string length which occurs when a string is pressed against a fret and to achieve that closer approach without changing the playing characteristics of the instrument.

SUMMARY OF THE INVENTION

In accordance with the preferred embodiment of this invention, the cap of the fret includes sides which converge towards intersection with the central axis of the fret so as to provide a narrow flat or string bearing surface when the cap top is ground to establish proper spacing between the strings and fret tops.

In accordance with one feature of this invention, the cap is triangular in cross-section so as to provide a narrow flat when the apex of the triangle is ground away.

In accordance with another feature of this invention, the sides of the cap diverge from the cap base at a small angle so as to reduce finger drag on the frets during play and thereby avoid degradation of playing characteristics of the instrument.

A better understanding of these and other objects and features of the invention will be facilitated by reference to the following drawing and detailed description.

DETAILED DESCRIPTION

Figure 1:
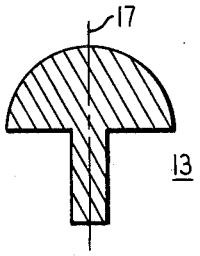
FIG. 1 is an end elevation view of a prior art fret.
Figure 2:
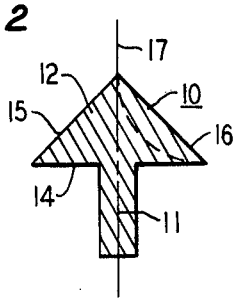
FIG. 2 is an end elevation view of a fret made in accordance with this invention.

Referring to FIG. 2, a fret 10 is disclosed which comprises a stem 11 and a cap 12. For comparison purposes, a prior art fret 13 is shown in FIG. 1. The fret 10 is ordinarily make of nickel silver and the cap 12 includes a base 14 and two sides 15 and 16. A central axis 17 passes longitudinally through the long axis of the stem 11 and the sides 15 and 16 diverge away from the base 14 so as to intersect with the axis 17.

Figure 3:
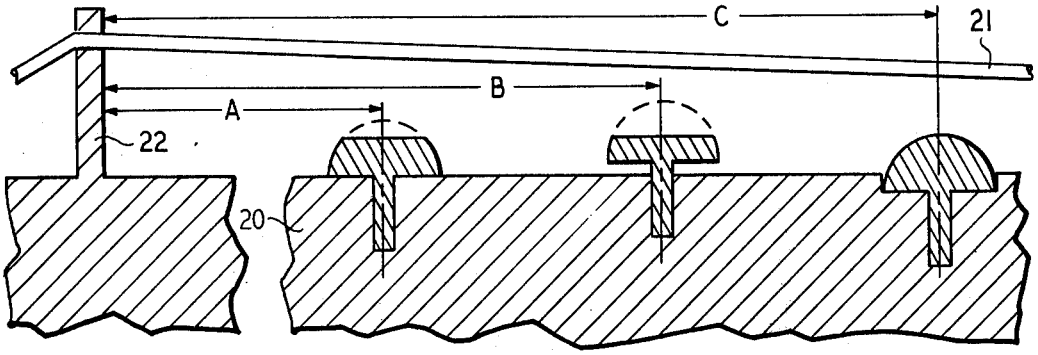
FIG. 3 is a side elevation view of a portion of the neck of a stringed instrument showing prior art frets in place beneath at least one string and including another portion of the instrument showing the junction point between string and bridge.
Figure 4:
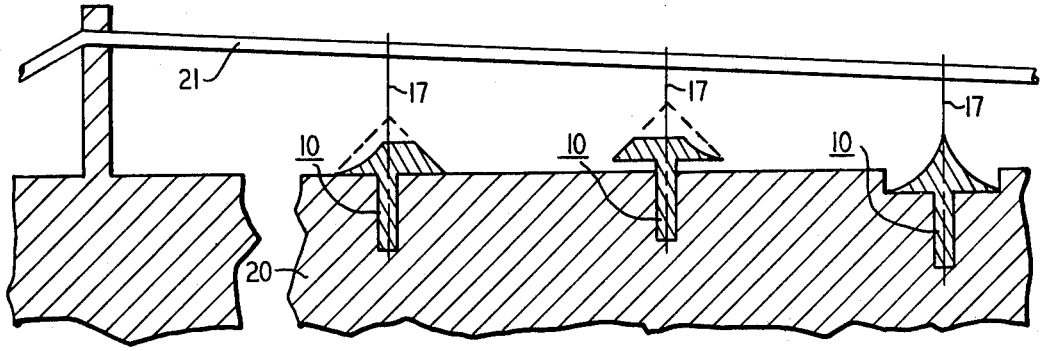
FIG. 4 is a side elevation view of the neck portion shown in FIG. 3, wherein the prior art frets have been replaced by frets made in accordance with this invention.

As best seen in FIG. 4, the frets 10 are inserted in a neck 20 of a stringed instrument so that the caps 12 are interposed between the surface of the neck 20 and one or more strings 21. For comparison purposes, the neck 20 is shown in FIG. 3, equipped with prior art frets 13.

As illustrated in FIGS. 3 and 4, the caps of the frets have been ground down so that the resulting flat surfaces will all lie in a common plane. The common plane is parallel to the neck surface so all of the ground surfaces are thereby disposed predetermined distances from the strings.

As shown in FIG. 4, the string 21 is fixed at one end to a bridge 22. Moreover, the frets 10 have been spaced on the neck 20 so that the lengths A, B and C are established between the bridge 22 and each axis 17, respectively. The lengths A, B and C are selected by reference to the vibratory characteristics of the string 21. That is, each length A, B or C is such that if the string 21 were cut to any of those lengths, it would vibrate at each length with a precise tone desired by the instrument manufacturer.

Figure 5:
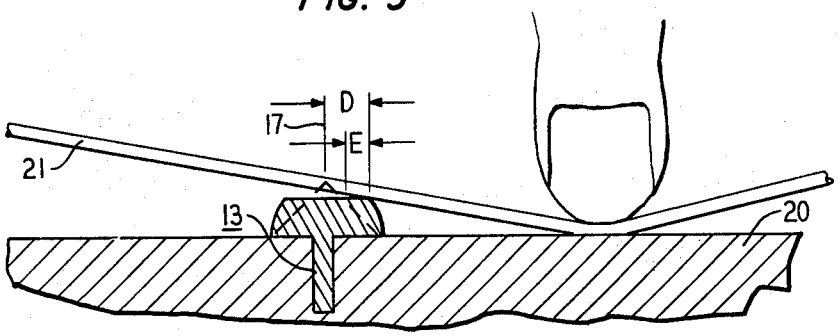
FIG. 5 is an end elevation view of a prior art fret shown in contact with a depressed string and having a phantom overlay thereon of a fret made in accordance with this invention.

In operation of the stringed instrument, a player's finger, as shown in FIG. 5, depresses the string 21 until it engages the surface of the neck 20. The result is to angle the string 21 downwardly from the bridge 22 so that some point thereon comes into contact with a fret. Where the cap of the fret has been ground down, however, the point of contact will be further from the bridge 22 than is the axis 17. Consequently, the actual string length created by bringing the string into contact with the fret will be greater than the design string length. As a result, the string will not provide the precise tone desired when it is plucked.

When the sides 15 and 16 of a cap 12 are straight or concave with respect to the base 14, the width of the ground-off flat on the top of the cap will be less than the width of the ground-off flat in prior art frets. Referring to FIG. 5, a comparison is illustrated. As shown, the point of contact between the string 21 and the flat on the ground-off prior art fret is disposed a distance D from the axis 17. By comparison, when the side 16 is straight or concave, the point of contact will be a distance D minus E from the axis 17. Since E is smaller than D, use of the frets disclosed herein will produce a more precise tone. In other words, utilizing the fret configuration described herein will bring the actual string length closer to coincidence with the designed string length thereby reducing the difference between the actual and designed tones.

While the frets 12 have been disclosed as having straight sides 16, as partially illustrated in FIGS. 2 and 4, those sides may also be concave in relationship to the base 14. In fact, the configuration of the sides 16 can take any convenient shape so long as it lies in a spacial segment defined on one side by the base 14 and on the other side by a straight line connected to the end point of the base 14 and diverging towards the axis 17.

It has been discovered, however, that by making the side 16 straight, as well as the side 15, an excellent balance is achieved between playing comfort and precision of tone. That is, slanted sides reduce the size of the ground-off flat. At the same time, however, they provide a sloping ramp which avoids finger drag as the user plays the instrument. Where straight sides are used, the angle between the base 14 and the sides 15 and 16 can conveniently fall in the range of 25° to 60° for a fret having a base width and height of about ⅛ of an inch. For particularly good results, however, the angle should be approximately 45°.

In summary, a fret configuration has been disclosed which will make the actual string length of a stringed instrument come closer to coincidence with the design string length without adversely effecting playing characteristics. While only a single embodiment has been disclosed, it will be recognized that the embodiment is merely an illustration of the principles of the invention and many other variations falling within the scope of the invention will readily occur to those skilled in the art.

What I claim is:

1. A fret adapted for insertion in the neck of an instrument having one or more strings disposed a predetermined height above the surface of said neck comprising:
   an elongated stem adapted to engage said neck for mounting purposes, said stem having a central axis passing longitudinally through its long axis, and
   a cap for engaging a string when said string is deflected toward said neck by a player's finger, said cap having a base centrally attached to one end of said stem and two sides converging above said base (so as to intersect) and intersecting at said central axis and at least one side lying in a spacial segment defined on one border by said base and on the other border by a straight line diverging towards said central axis from a point of intersection with the end of said base.

2. A fret in accordance with claim 1, wherein both of said sides are concave in respect to said base.

3. A fret in accordance with claim 1, wherein said sides are straight lines.

4. A fret in accordance with claim 1, wherein one of said sides diverges away from said base at an initial angle in the range of 25° to 60°.

5. A fret in accordance with claim 4, wherein said side diverges away from said base at an angle of approximately 45°.

* * * * *